US008162105B1

(12) United States Patent
Ohland

(10) Patent No.: US 8,162,105 B1
(45) Date of Patent: Apr. 24, 2012

(54) FIRE ESCAPE DEVICE

(76) Inventor: Robert A. Ohland, Bangor, PA (US)

( * ) Notice: Subject to any disclaimer, the term of this patent is extended or adjusted under 35 U.S.C. 154(b) by 135 days.

(21) Appl. No.: 12/695,040

(22) Filed: Jan. 27, 2010

(51) Int. Cl.
*A62B 1/00* (2006.01)

(52) U.S. Cl. ..... 182/74; 182/70; 182/196

(58) Field of Classification Search ..... 182/70, 182/74, 195–198
See application file for complete search history.

(56) References Cited

U.S. PATENT DOCUMENTS

| | | | | | |
|---|---|---|---|---|---|
| 369,681 | A | * | 9/1887 | Bemish | 182/74 |
| 819,956 | A | * | 5/1906 | Hopflinger et al. | 182/70 |
| 1,123,029 | A | * | 12/1914 | Smith | 182/70 |
| 1,360,831 | A | * | 11/1920 | Turner | 182/74 |
| 2,513,835 | A | * | 7/1950 | Allen | 182/209 |
| 2,616,608 | A | * | 11/1952 | Bellamy | 182/70 |
| 3,344,886 | A | * | 10/1967 | Boscarino, Jr. | 182/70 |
| 3,692,145 | A | | 9/1972 | Banner | |
| 4,127,184 | A | * | 11/1978 | Strohmeyer | 182/70 |
| 4,164,991 | A | * | 8/1979 | Marra | 182/70 |
| 4,425,983 | A | | 1/1984 | Reinhard | |
| 5,022,690 | A | | 6/1991 | Coltrin et al. | |
| 5,303,799 | A | | 4/1994 | Tsai | |
| D370,736 | S | | 6/1996 | Douglas et al. | |
| 5,842,539 | A | | 12/1998 | Hough | |
| 6,328,129 | B1 | | 12/2001 | Ferguson | |
| 6,382,352 | B1 | | 5/2002 | Dowe, Sr. | |
| 2004/0108163 | A1 | | 6/2004 | Johnson | |

* cited by examiner

*Primary Examiner* — Alvin Chin Shue
*Assistant Examiner* — Daniel Cahn

(57) ABSTRACT

A fire escape device featuring a housing mountable outside windows, the bottom panel of the housing is pivotally attached to the back panel, the bottom panel can move between an open position and a closed position; a collapsible chain ladder attached to the back panel of the housing, the collapsible chain ladder can move between a rolled position an unrolled position wherein the collapsible chain ladder hangs downwardly from inside the housing; and a securing mechanism that can move between an engaged and disengaged position, when the securing mechanism is in the engaged position the bottom panel is in the closed position and the chain ladder is in the rolled position, when the securing mechanism is moved to the disengaged position the bottom panel is moved to the open position and the chain ladder can move from the rolled position to the unrolled position and fall downwardly from the housing.

8 Claims, 7 Drawing Sheets

FIRE ESCAPE DEVICE

FIELD OF THE INVENTION

The present invention is directed to a fire escape ladder for permanently attaching to the outside of a window.

BACKGROUND OF THE INVENTION

Fire escapes are commonly found on large buildings and apartment complexes. Homes, however, generally do not have fire escapes. The present invention features a fire escape device for attaching outside of a window. The fire escape device is designed to be aesthetically pleasing so as not to detract from the appearance of the home.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY

The present invention features a fire escape device comprising a housing having a first side panel, a second side panel, a front panel, a back panel, a bottom panel, and an inner cavity, the inner cavity is divided into an upper chamber and a lower chamber separated by a dividing panel, the back panel of the housing is mountable to a wall area outside a window of a building via an attachment means, the bottom panel of the housing is pivotally attached to the back panel via a hinge, the bottom panel can move between an open position and a closed position respectively allowing and preventing access to the lower chamber; a collapsible chain ladder disposed in the lower chamber of the housing, wherein a top end of the collapsible chain ladder is rigidly attached to the back panel of the housing and a bottom end of the collapsible chain ladder is free, the collapsible chain ladder can move between a rolled position wherein the collapsible chain ladder is rolled and contained within the lower chamber and an unrolled position wherein the collapsible chain ladder hangs downwardly from the housing; a pin disposed in the tower chamber of the housing extending from the first side panel to the second side panel, the pin is positioned near the front panel, wherein the collapsible chain ladder is draped over the pin; and a securing mechanism for securing the bottom panel of the housing in the closed position, the securing mechanism can move between an engaged position and a disengaged position, wherein when the securing mechanism is in the engaged position the bottom panel of the housing is in the closed position and the chain ladder is in the rolled position, wherein when the securing mechanism is moved to the disengaged position the bottom panel of the housing is moved to the open position and the chain ladder can move from the rolled position to the unrolled position and fall downwardly from the housing.

In some embodiments, one or more handles are disposed on the housing. In some embodiments, the attachment means includes a bolt or a mounting bracket. In some embodiments, the chain ladder comprises a first side chain, a second side chain, and a plurality of rungs connecting the first side chain and the second side chain. In some embodiments, a bolt is driven through the back panel of the housing in the upper chamber for mounting the housing to the wall. In some embodiments, the upper chamber functions as a flowerbed or as a storage device. In some embodiments, a seal is disposed below or around the dividing panel to help to keep moisture away from the collapsible chain ladder in the lower chamber.

In some embodiments, the securing mechanism includes a locking pin that engages a latch, the latch is disposed in the lower chamber of the housing on the bottom panel of the housing near front panel, the locking pin is disposed in the wall area such that a first end of the locking pin extends into the building and a second end of the locking pin extends through the back panel of the housing and into the lower chamber of the housing, the second end of the locking pin can move in and out of the latch, wherein the locking pin can move between an engaged position wherein the second end of the locking pin is slid through the latch and a disengaged position wherein the locking pin is pulled out of the latch. In some embodiments, the locking pin is biased in the engaged position caused by a spring threaded along the locking pin. In some embodiments, a knob is disposed on the first end of the locking pin.

DESCRIPTION OF PREFERRED EMBODIMENTS

Figure 1:
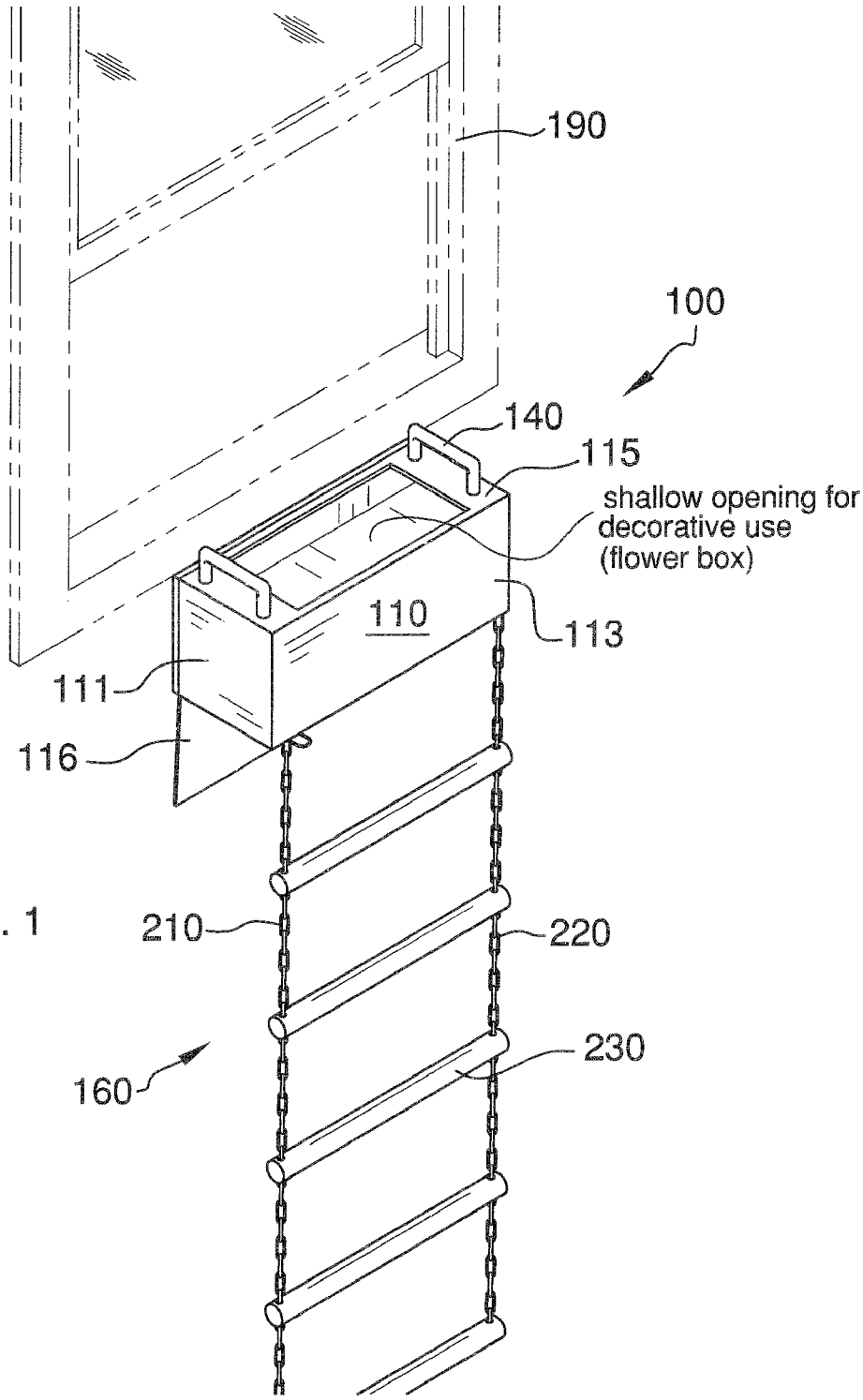
FIG. 1 is a perspective view of the fire escape device of the present invention as used in a window.
Figure 2A:
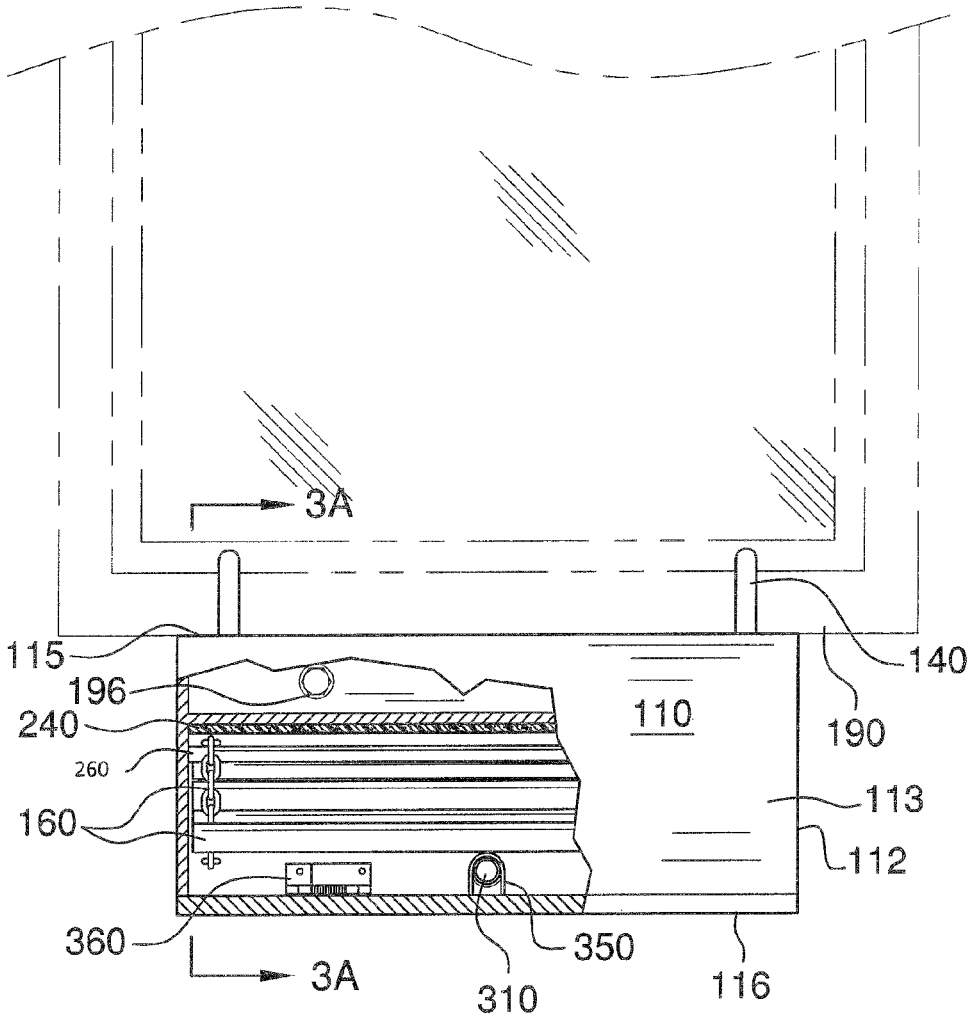
FIG. 2A is a front and cross sectional view of the fire escape device of the present invention, wherein the bottom panel of the housing is in the closed position.
Figure 2B:
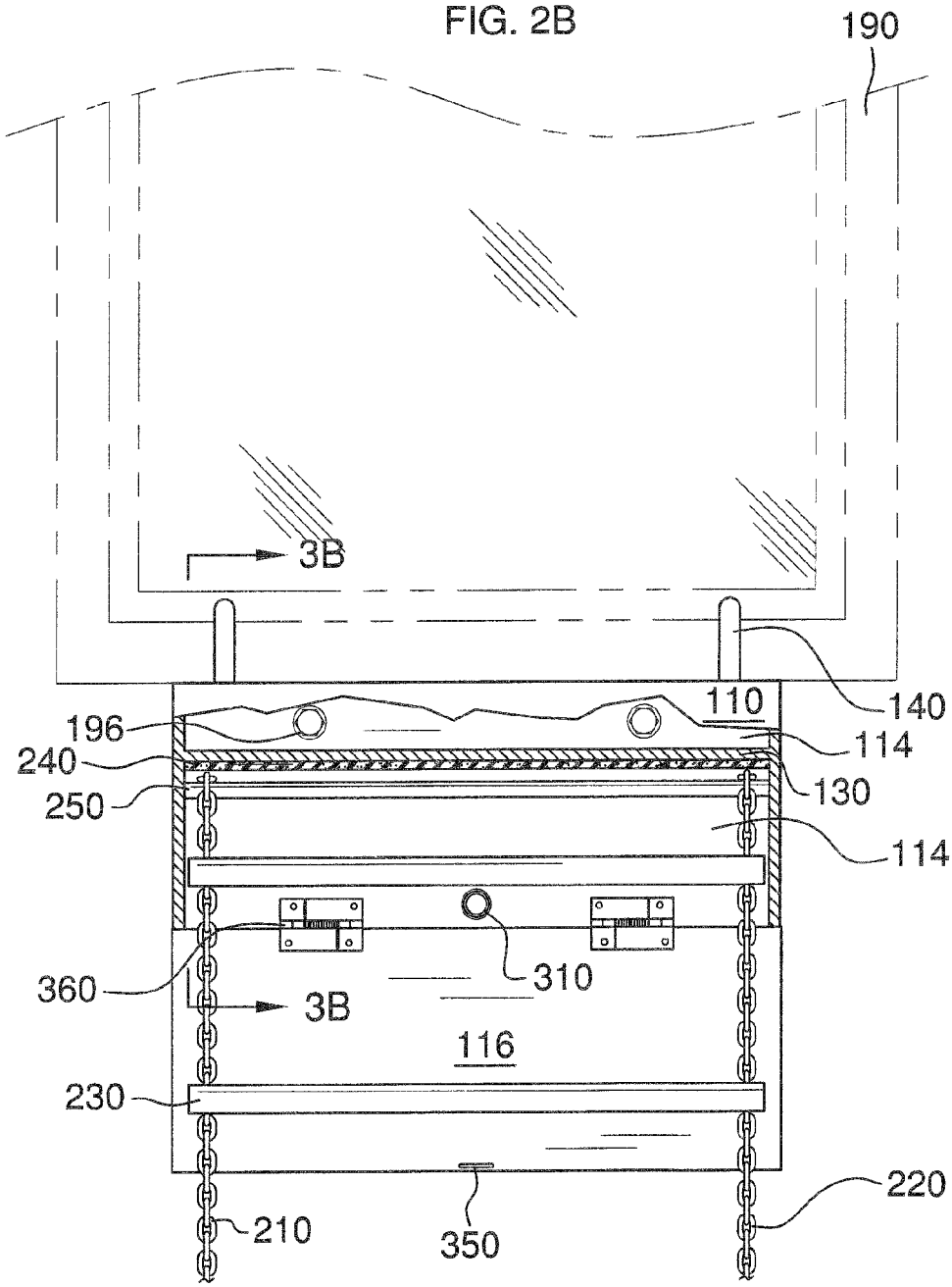
FIG. 2B is a front and cross sectional view of the fire escape device of the present invention, wherein the bottom panel of the housing is in the open position.
Figure 3A:
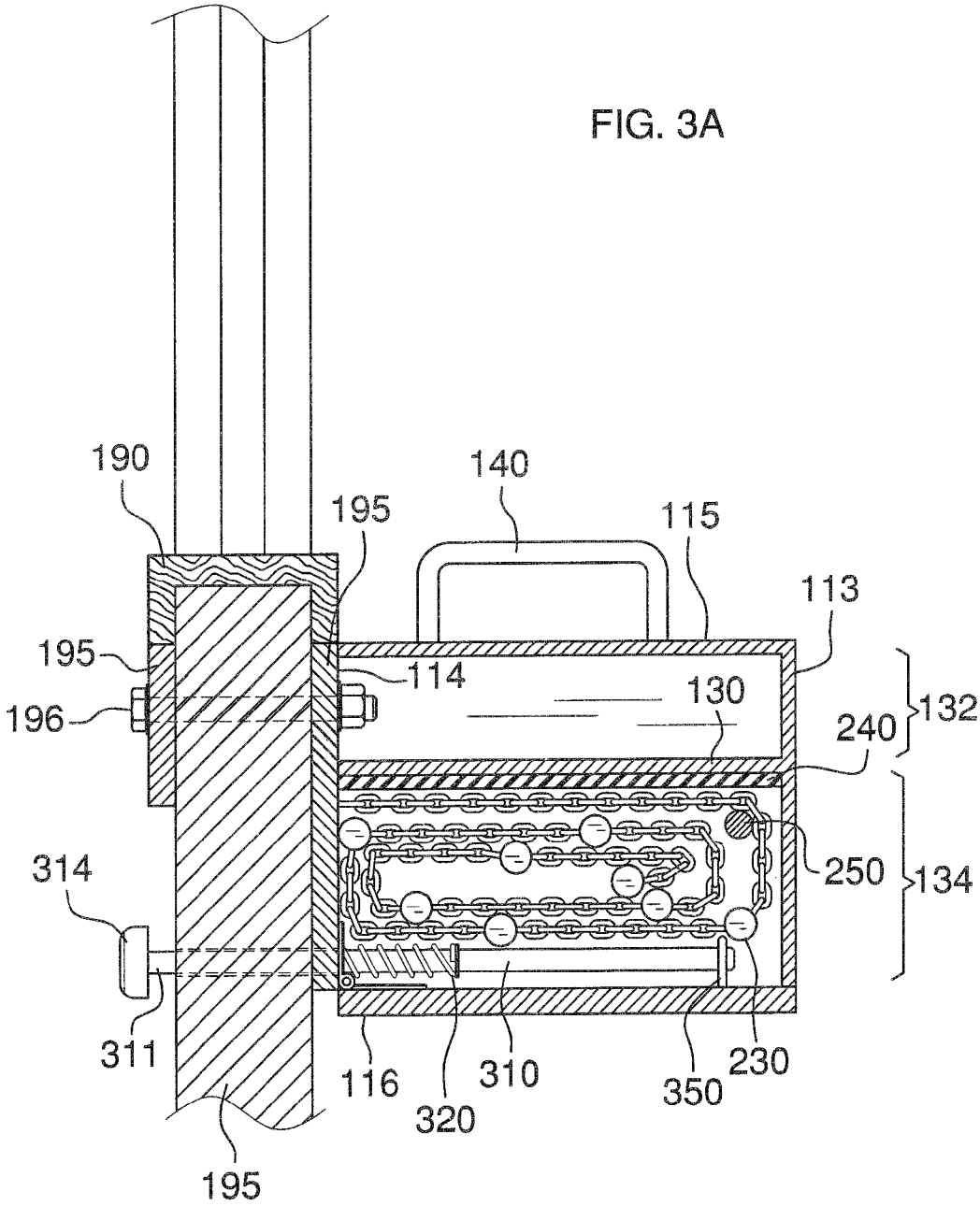
FIG. 3A is a side and cross sectional view of the fire escape device of the present invention, wherein the bottom panel of the housing is in the closed position.
Figure 3B:
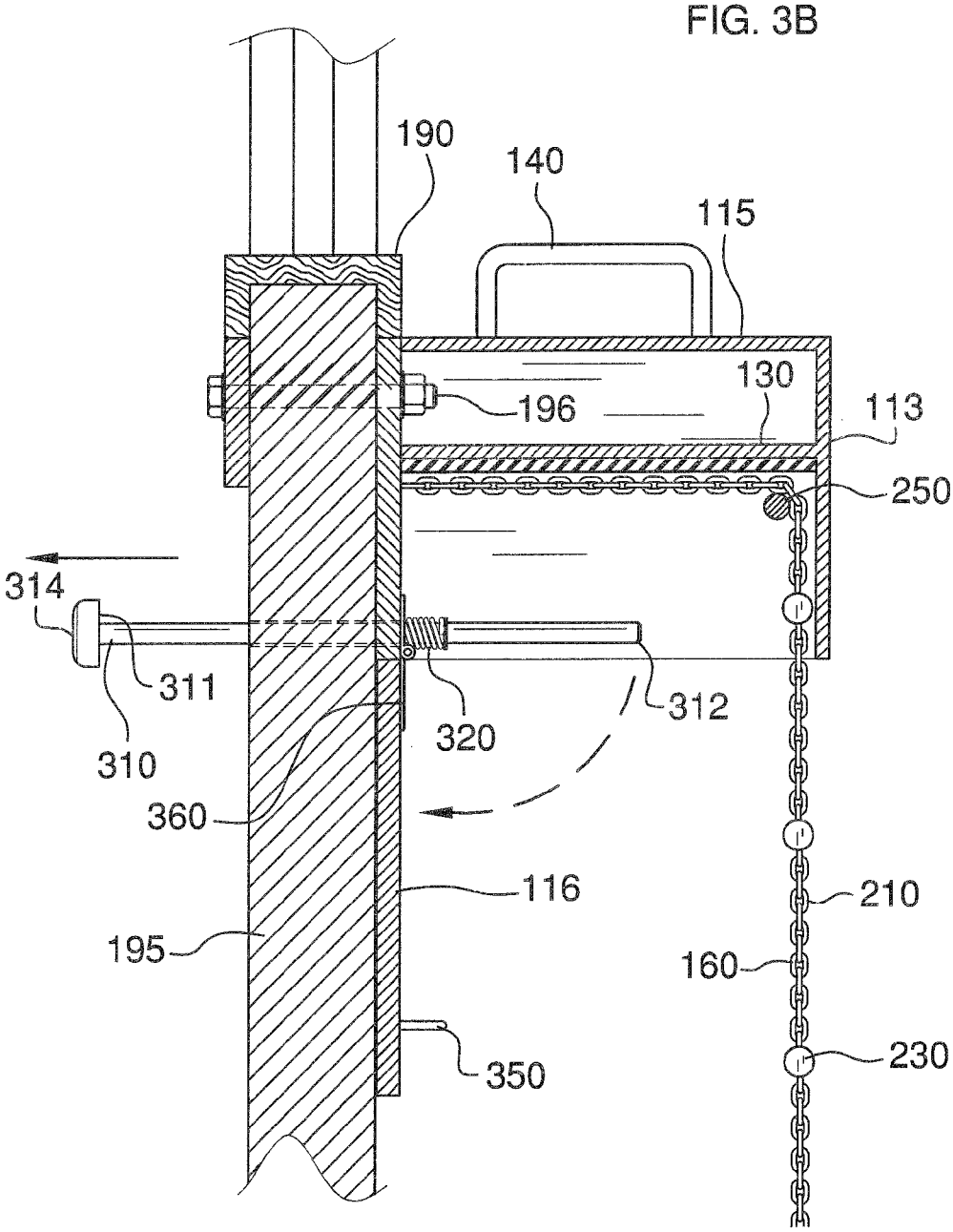
FIG. 3B is a side and cross sectional view of the fire escape device of the present invention, wherein the bottom panel of the housing is in the open position.

Referring now to FIGS. 1-5, the present invention features a fire escape device 100 for permanently attaching outside of a window 190 of a building or home.

The fire escape device 100 of the present invention comprises a housing 110 having a first side panel 111, a second side panel 112, a front panel 113, a back panel 114, a top panel 115, a bottom panel 116, and an inner cavity formed by the panels 111, 112, 113, 114, 115, 116. The back panel 114 can be mounted on a wall area 195 around (e.g., below) the window 190 via an attachment means (e.g., bolt 196). In some embodiments, the back panel 114 of the housing 110 is permanently attached to the wall 195 via a mounting bracket and a bolt 196.

The bottom panel 116 of the housing 110 is pivotally attached to the back panel 114 of the housing 110. The bottom panel 116 functions as a door and can move between an open position and a closed position. The bottom panel 116 is pivotally attached to the back panel 114 via a hinge 360. In some embodiments, one or more handles 140 are disposed on the housing 110, for example on the top panel 115.

The inner cavity of the housing 110 is divided into an upper chamber 132 and a lower chamber 134 separated by a dividing panel 130. The upper chamber 132 may be the portion of the inner cavity of the housing 110 between the top panel 115 of the housing 110 and the dividing panel 130, and the lower chamber 134 may be the portion of the inner cavity of the housing 110 between the bottom panel 116 and the dividing panel 130 (see FIG. 3A). The upper chamber 132 of the housing 110 may be used for attaching the housing 110 to a wall 195. For example, a bolt 196 can be driven through a portion of the back panel 114 of the housing 110, the portion being in the upper chamber 132 (see FIG. 3A). In some embodiments, the upper chamber 132 is used for various other purposes, for example the upper chamber 132 may function as a flowerbed (with flowers 660 and/or dirt 662) or as a storage device. The upper chamber 132 is not limited to the aforementioned functions. FIG. 1 shows a shallow opening 260 in the housing 110, which can be used for things like a flowerbed, etc.

The lower chamber 134 of the housing 110 encloses a collapsible chain ladder 160. Chain ladders are well known to one of ordinary skill in the art. For example, the chain ladder 160 comprises a first side chain 210, a second side chain 220, and a plurality of rungs 230 disposed along the first side chain 210 and second side chain 220. The collapsible chain ladder 160 can move between a rolled (or storage) position (e.g., contained within the housing 110, such as in the lower chamber 134, rolled up (see FIG. 2A and FIG. 3A)) and an unrolled position wherein the ladder 160 hangs downwardly from the housing 110 (see FIG. 2B and FIG. 3B). The top end of the collapsible chain ladder 160 is permanently attached to the housing 110 (e.g., the back panel 114), while the bottom end of the collapsible chain ladder 160 is free to fall out of the housing 110 when needed.

In some embodiments, a pin 250 is disposed in the lower chamber 134 of the housing 110 near the front panel 113. The pin 250 extends from the first side panel 111 to the second side panel 112. In some embodiments, the collapsible chain ladder 160 is draped over the pin 250 such that when the collapsible chain ladder 160 falls downwardly from inside the housing 110 it is oriented near the front wall 113 of the housing 110 (see FIG. 3B) and not near the wall of the building.

In some embodiments, a seal 240 is disposed below or around the dividing panel 130. The seal 240 may help to keep moisture away from the chain ladder 160.

When the bottom panel 116 of the housing 110 is in the closed position, the chain ladder 160 is in the rolled position. When the bottom panel 116 of the housing 110 is moved to the open position, the chain ladder 160 can move from the rolled position to the unrolled position and fall downwardly from the housing 110 if needed.

Figure 5:
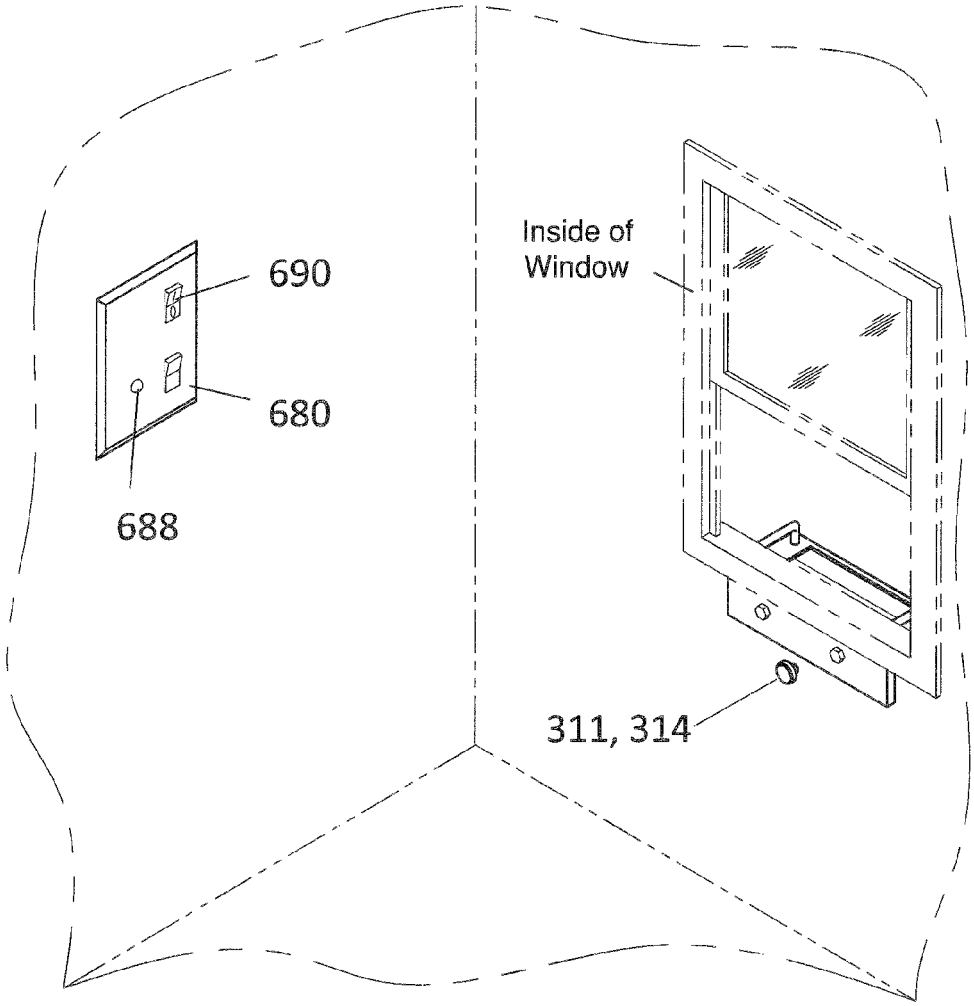
FIG. 5 is a perspective view of a window and wall of a house or building wherein a fire escape device is mounted outside of the window (the view is from the inside of the house as compared to FIG. 4, which is a view outside of the house). The locking pin extends inside the room.

In some embodiments, the bottom panel 116 of the housing 110 is secured in the closed position via securing mechanism, for example a locking pin and latch mechanism (e.g., the bottom panel 116 is biased in the closed position via a locking pin and latch mechanism). A latch 350 is disposed in the lower chamber 143 of the housing 110 on the bottom panel 116 of the housing 110. The latch 350 may be positioned on the bottom panel 116 near the front panel 113. The latch engages a locking pin 310. The locking pin 310 has a first end 311 and a second end 312, the second end being slidably insertable into the latch 350. The locking pin 310 can move between an engaged position wherein the second end 312 of the locking pin 310 is slid through the latch 350 (thereby keeping the bottom panel 116 of the housing 110 in the closed position) and a disengaged position wherein the locking pin 310 is pulled out of the latch 350 (thereby allowing the bottom panel 116 of the housing 110 to move to the open position). The locking pin 310 is driven through the wall 195 of the building such that the first end 311 of the locking pin 310 extends into the building (e.g., into a room) and the second end 312 of the locking pin 310 extends through the back panel 114 of the housing and into the lower chamber 134 of the housing 110 (along the bottom panel 116). The locking pin 310 is positioned such that the second end 312 of the locking pin 310 can move in and out of the latch 350 (see FIG. 3A, FIG. 3B). FIG. 5 shows the locking pin 310 (the first end 311, the knob 214) extending into the inside of the room.

The locking pin 310 is biased in the engaged position caused by a spring 320 threaded along the locking pin 310 inside the lower chamber 134 of the housing 110. The spring 320 is sandwiched between the back panel 114 of the housing 110 and a wing disposed on the locking pin 310. Such spring and locking pin mechanisms are well known to one of ordinary skill in the art.

To move the locking pin to the disengaged position, a user can pull the locking pin 310 away from the latch 350 (e.g., the locking pin 310 is pulled into the room in the building). This allows the second end 312 of the locking pin 310 to be pulled out of the latch 350. When the locking pin 310 is pulled out of the latch 350, the bottom panel 116 falls open, which allows the chain ladder 160 to fall downwardly for use. In some embodiments, a knob 314 is disposed on the first end 311 of the locking pin 310. The knob 314 can help a user grip the locking pin 310 when it needs to be pulled to open the housing 110.

The fire escape device 100 may be constructed in a variety of sizes to accommodate various sizes of windows 190 and buildings or homes. The chain ladder 160 can be constructed in a variety of lengths to accommodate various heights of windows 190.

Figure 4:
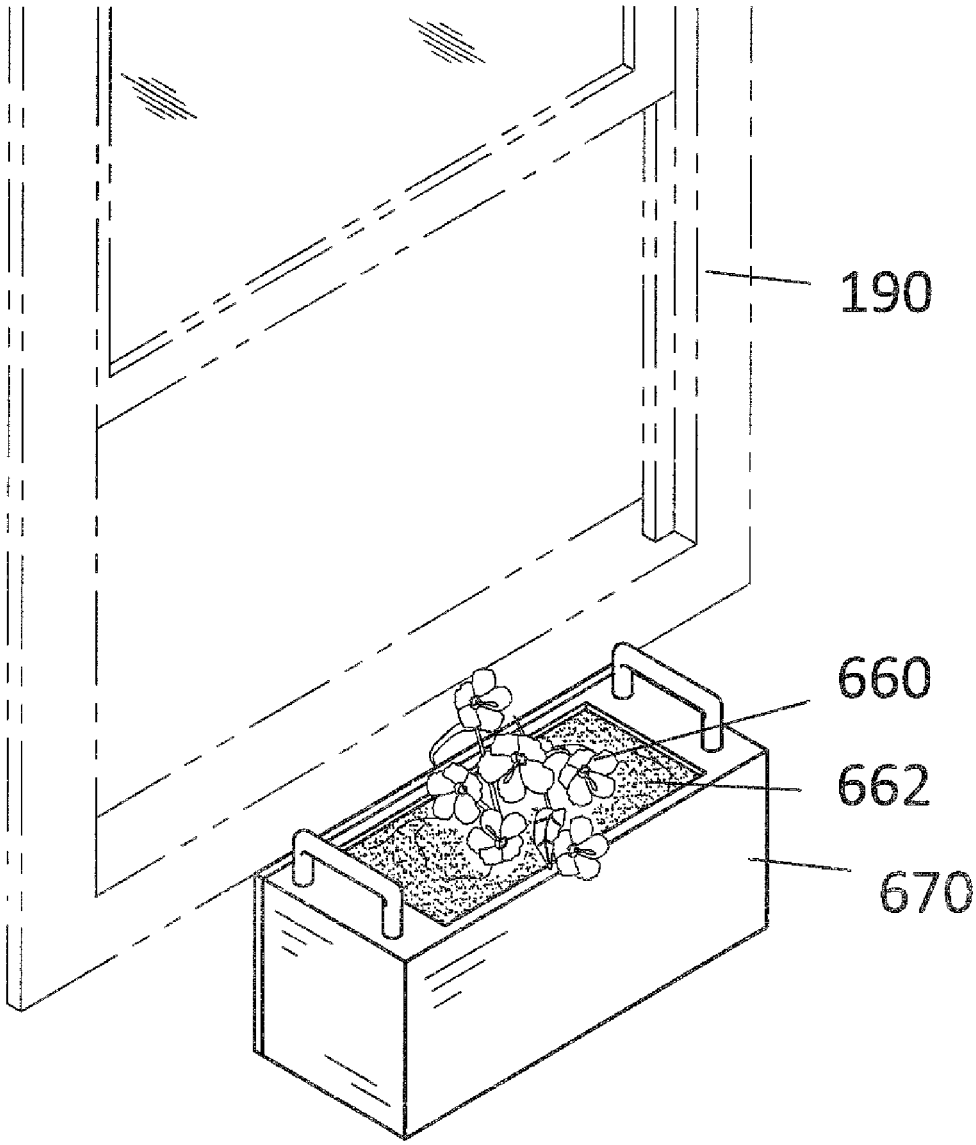
FIG. 4 is a perspective view of a dummy box mounted on a window.

In some embodiments, housings 110 (e.g., without the chain ladder 160) may also be installed in other windows of the home of building. This can help the home or building look more uniform and aesthetically pleasing. In some embodiments, the device 100 of the present invention is mounted in one or more windows in a home, while a dummy box 670 is mounted in other windows. FIG. 4 shows an example of a dummy box 670, which holds flowers 660 and dirt 662.

The bottom panel 116 of the housing 110 may be manipulated in other ways (other than the locking pin and latch mechanism). In some embodiments, the bottom panel 116 of the housing 110 can be moved to the open position via an electronic mechanism. For example, a latch on the bottom panel 116 of the housing 110 is operatively connected to an electrical system (e.g., via electrical contacts, low voltage electrical contacts), the electrical system being operatively connected to an alarm system (e.g., smoke alarm system). When the smoke alarm system is activated, the electrical system causes the latch on the bottom panel 116 to be disengaged, thereby opening the bottom panel 116 of the housing. In some embodiments, a housing indicator light is disposed on the housing 110, which can indicate if the device has been triggered.

As shown in FIG. 5, a control panel 680 may be mounted in the room of the building. The control panel 680 may be operatively connected to the electrical system, which is operatively connected to the latch on the bottom panel 116 of the housing 110 (and the control panel 680 may be optionally operatively connected to the aforementioned alarm system). In some embodiments, the electrical system is operatively connected to a switch 690 disposed on the control panel. A user can activate the fire escape device 100 by pressing the switch 690.

As shown in FIG. 5, the control panel 680 may comprise an indicator light 688, which is illuminated if the electrical system is activated (e.g., if a user activates the fire escape device 100 of the present invention or if the alarm system activates the fire escape device 100 of the present invention).

Optional set of contacts that can trigger the device from an alarm panel or some other remote location. Also ability to have an indicator light to show the device has been triggered (both should be low voltage).

The following the disclosures of the following U.S. Patents are incorporated in their entirety by reference herein: U.S. Pat. No. 5,022,690; U.S. Pat. No. 6,382,352; U.S. Pat. No. 6,328,129; U.S. Pat. No. 4,425,983; U.S. Pat. No. 3,692,145; U.S. Pat. No. 5,303,799; U.S. Pat. No. 5,842,539; U.S. Pat. Application No. 2004/0108163.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A fire escape device comprising:

(a) a housing having a first side panel, a second side panel, a front panel, a back panel, a bottom panel, and an inner cavity, the inner cavity is separated by a dividing panel into an upper chamber and a lower chamber, the back panel of the housing is mountable to a wall area outside a window of a building via an attachment means, the bottom panel of the housing is pivotally attached to the back panel via a hinge, the bottom panel can move between an open position and a closed position respectively allowing and preventing access to the lower chamber, wherein the bottom panel can be the only one of said panels to move and allow access to the lower chamber;

(b) a collapsible chain ladder disposed in the lower chamber of the housing, wherein a top end of the collapsible chain ladder is rigidly attached to the back panel of the housing and a bottom end of the collapsible chain ladder is free, the collapsible chain ladder can move between a rolled position wherein the collapsible chain ladder is rolled and contained within the lower chamber and an unrolled position wherein the collapsible chain ladder hangs downwardly from and below the housing;

(c) a pin disposed in the lower chamber of the housing extending from and directly connected to the first side panel and the second side panel, the pin is positioned near the front panel so that the chain ladder is directly connected to the back panel via the top end and then extends toward the front side panel to a location of the chain ladder that is draped over the pin; and (d) a securing mechanism for securing the bottom panel of the housing in the closed position, the securing mechanism can move between an engaged position and a disengaged position; wherein when the securing mechanism is in the engaged position, the bottom panel of the housing is in the closed position and the chain ladder is in the rolled position; wherein when the securing mechanism is in the disengaged position, the bottom panel of the housing can be in the open position and the chain ladder can move from the rolled position to the unrolled position; the securing mechanism includes a locking pin that engages a latch, the latch is disposed within the lower chamber of the housing and is directly attached to the bottom panel of the housing and positioned near the front panel, the locking pin is capable of being disposed in a wall of a building such that a first end of the locking pin can extend into the building; a second end of the locking pin extends through the back panel of the housing and into the lower chamber of the housing, the second end of the locking pin can move in and out of the latch, wherein the locking pin can move between the engaged position wherein the second end of the locking pin is slid through the latch and the disengaged position wherein the locking pin is pulled out of the latch;

(e) the attachment means is selected from a group consisting of a bolt and a mounting bracket.

2. The fire escape device of claim 1, wherein one or more handles are disposed on the housing.

3. The fire escape device of claim 1, wherein the chain ladder comprises a first side chain, a second side chain, and a plurality of rungs connecting the first side chain and the second side chain.

4. The fire escape device of claim 1, wherein a bolt is disposed through the back panel of the housing in the upper chamber for mounting the housing to the wall.

5. The fire escape device of claim 1, wherein the upper chamber functions as a flowerbed or as a storage device.

6. The fire escape device of claim 1, wherein a seal is disposed below or around the dividing panel to help to keep moisture away from the collapsible chain ladder in the lower chamber.

7. The fire escape device of claim 1, wherein the locking pin is biased in the engaged position caused by a spring threaded along the locking pin.

8. The fire escape device of claim 1, wherein a knob is disposed on the first end of the locking pin.

* * * * *